US011591783B2

(12) United States Patent
Payziev et al.

(10) Patent No.: US 11,591,783 B2
(45) Date of Patent: Feb. 28, 2023

(54) TOILET VENTILATION SYSTEM

(71) Applicants: Akmal Payziev, Nashville, TN (US); Umidjon Payziev, Nashville, TN (US); Shukhrat Akromov, Nashville, TN (US)

(72) Inventors: Akmal Payziev, Nashville, TN (US); Umidjon Payziev, Nashville, TN (US); Shukhrat Akromov, Nashville, TN (US)

( * ) Notice: Subject to any disclaimer, the term of this patent is extended or adjusted under 35 U.S.C. 154(b) by 0 days.

(21) Appl. No.: 16/720,928

(22) Filed: Dec. 19, 2019

(65) Prior Publication Data

US 2020/0123755 A1 Apr. 23, 2020

Related U.S. Application Data

(60) Provisional application No. 62/887,449, filed on Aug. 15, 2019.

(51) Int. Cl.
*E03D 9/052* (2006.01)
*A47K 13/30* (2006.01)

(52) U.S. Cl.
CPC ..... *E03D 9/052* (2013.01); *A47K 13/307* (2013.01)

(58) Field of Classification Search
CPC ..... E03D 9/052; E03D 9/05; A47K 13/307
USPC ..... 4/321, 353
See application file for complete search history.

(56) References Cited

U.S. PATENT DOCUMENTS 688,234 A * 12/1901 Brown ..... E03D 9/052 4/213
747,658 A * 12/1903 Stevens ..... E03D 9/052 4/213
908,393 A * 12/1908 Cline ..... E03D 9/052 4/216
1,165,836 A * 12/1915 Blanchard ..... E03D 9/052 4/214
1,498,789 A * 6/1924 Drouillard ..... E03D 9/052 417/423.14

(Continued)

FOREIGN PATENT DOCUMENTS

CN 2458371 11/2001
CN 264252 10/2004

(Continued)

OTHER PUBLICATIONS

EP Application No. 15729618.7, Communication pursuant to Article 94(c) EPC dated Mar. 21, 2018.

(Continued)

*Primary Examiner* — Benjamin R Shaw
(74) *Attorney, Agent, or Firm* — Bradley Arant Boult Cummings LLP; Timothy L. Capria; Alexandra C. Lynn

(57) ABSTRACT

A toilet bowl ventilation system exhausts air in and around the toilet bowl to an area adjacent to the room in which the toilet is located. The toilet bowl ventilation system includes an odor exhaust system which is configured to be installed within the interior cavity of a toilet. The odor exhaust system includes a fan positioned within a housing. The system further includes a controller that regulates power to the fan. Upon activation, the system is operable to transport air from in and around the toilet bowl, through the housing, and to an area adjacent to the room in which the toilet is located (e.g. outdoors).

20 Claims, 15 Drawing Sheets

(56) References Cited

U.S. PATENT DOCUMENTS 1,955,579 A * 4/1934 De Malaussene ..... E03D 9/052 4/213
1,972,774 A * 9/1934 Hartwell ..... E03D 9/052 4/213
1,984,403 A * 12/1934 Edelman ..... E03D 1/01 220/315
2,041,962 A * 5/1936 Robertson ..... E03D 9/052 4/213
2,058,436 A * 10/1936 Friel ..... E03D 9/052 4/213
2,151,138 A * 3/1939 Earls ..... E03D 9/052 4/213
2,329,221 A * 9/1943 Sanford ..... E03D 9/052 4/213
2,575,778 A * 11/1951 Wilson ..... E03D 9/052 4/213
2,677,830 A * 5/1954 Allen ..... E03D 9/052 4/213
2,847,682 A * 8/1958 Shay ..... E03D 9/052 4/213
3,068,490 A * 12/1962 Pokras ..... E03D 1/01 4/353
3,120,006 A * 2/1964 Knappe ..... E03D 11/06 4/213
3,259,917 A * 7/1966 Rascov ..... E03D 3/00 4/319
3,273,170 A * 9/1966 Wheeler ..... E03D 9/052 4/348
3,436,767 A * 4/1969 Bela ..... E03D 9/031 4/213
3,534,415 A * 10/1970 Huffman ..... E03D 9/052 4/213
3,571,824 A * 3/1971 Poister ..... E03D 9/052 4/213
3,763,505 A * 10/1973 Zimmerman ..... E03D 9/052 4/213
3,805,304 A * 4/1974 Ikehata ..... E03D 9/052 4/352
3,887,949 A 6/1975 Osmond
4,222,129 A * 9/1980 Baker ..... E03D 9/052 4/213
4,365,361 A * 12/1982 Sanstrom ..... E03D 9/052 4/216
4,371,992 A * 2/1983 Rivera ..... E03D 5/006 4/353
4,472,841 A * 9/1984 Faulkner ..... E03D 9/052 4/213
4,586,201 A 5/1986 Todd
4,944,045 A * 7/1990 Agelatos ..... E03D 9/052 4/213
4,993,083 A * 2/1991 Lemieux ..... E03D 9/052 4/216
5,199,111 A * 4/1993 Antepenko ..... E03D 9/052 4/209 R
5,231,705 A * 8/1993 Ragusa ..... E03D 9/05 4/213
5,257,421 A * 11/1993 Rose ..... E03D 9/052 4/209 R
5,355,536 A 10/1994 Prisco
5,388,280 A * 2/1995 Sim ..... E03D 5/00 4/209 R
5,454,122 A * 10/1995 Bergeron ..... E03D 9/052 4/213
5,539,937 A 7/1996 Barefoot
5,689,837 A * 11/1997 Katona ..... A61L 9/122 4/214
5,704,074 A * 1/1998 Baldea ..... E03D 9/052 4/213
5,806,104 A * 9/1998 Hand ..... E03D 9/05 4/209 FF
5,829,066 A * 11/1998 Aibe ..... E03D 9/052 4/213
5,862,536 A * 1/1999 Huang ..... E03D 1/01 4/353
5,940,893 A * 8/1999 Shum ..... E03D 9/05 4/213
6,003,157 A * 12/1999 Bruyere ..... E03D 9/052 15/327.6
6,016,576 A * 1/2000 Happe ..... E03D 9/05 4/213
6,173,453 B1 * 1/2001 Shahar ..... E03D 9/05 4/213
6,260,215 B1 7/2001 Miller
6,295,656 B1 * 10/2001 Tillen ..... E03D 9/05 4/216
6,351,855 B1 * 3/2002 Allen ..... E03D 9/05 4/213
6,499,150 B1 * 12/2002 Thompson ..... E03D 9/052 4/213
6,526,598 B1 * 3/2003 Black ..... F03D 9/20 4/214
6,546,567 B2 4/2003 Kuzniar
6,637,040 B1 * 10/2003 Alba ..... A47K 13/307 4/217
6,678,900 B2 * 1/2004 Ware ..... E03D 9/05 4/209 FF
6,749,805 B2 * 6/2004 Parkhurst ..... A61L 9/00 4/347
6,760,928 B1 * 7/2004 Rodriguez ..... A47K 13/307 4/217
6,795,980 B1 9/2004 Ries
6,804,837 B1 * 10/2004 Guess, Sr. ..... E03D 9/052 4/213
6,944,888 B1 * 9/2005 Canales, Jr. ..... E03D 9/052 4/213
7,921,477 B2 4/2011 Casale
3,069,501 A1 12/2011 Casson et al.
9,103,104 B1 * 8/2015 Tom ..... E03D 9/052
10,480,168 B1 * 11/2019 Cox ..... E03D 5/094
2002/0069455 A1 * 6/2002 Pottinger ..... E03D 9/052 4/213
2003/0163863 A1 * 9/2003 Stone ..... E03D 9/052 4/213
2003/0229937 A1 * 12/2003 Curtis ..... E03D 9/052 4/216
2006/0200897 A1 * 9/2006 Taylor ..... E03D 9/052 4/216
2007/0143909 A1 * 6/2007 Montgomery ..... E03D 9/10 4/213
2007/0186334 A1 * 8/2007 Carter ..... A47K 13/307 4/213
2007/0234472 A1 * 10/2007 Podgorney ..... B60R 15/04 4/347
2008/0022444 A1 * 1/2008 Smith ..... E03D 9/052 4/348
2008/0086799 A1 * 4/2008 Bakhchadzyan ..... E03D 9/052 4/213
2008/0256693 A1 * 10/2008 Mickleson ..... E03D 9/05 4/216
2009/0056007 A1 * 3/2009 Pham ..... E03D 9/052 4/347
2009/0089920 A1 * 4/2009 Quick ..... E03D 9/052 4/214
2010/0043128 A1 * 2/2010 Soldera ..... E03D 9/052 4/213
2011/0047689 A1 * 3/2011 Gianelloni ..... E03D 9/052 4/348
2011/0099697 A1 * 5/2011 Weigart ..... A47K 13/307 4/217
2012/0023650 A1 2/2012 Azodi
2012/0227167 A1 9/2012 Ineson et al.
2012/0227170 A1 * 9/2012 Ineson ..... E03D 9/052 4/347
2012/0260414 A1 * 10/2012 Lee ..... E03D 9/052 4/347
2013/0042399 A1 * 2/2013 Smith ..... F23G 7/06 4/347

(56) References Cited

U.S. PATENT DOCUMENTS

| | | | | |
|---|---|---|---|---|
| 2013/0086736 | A1* | 4/2013 | Larouche | E03D 9/052 4/348 |
| 2013/0097770 | A1 | 4/2013 | Gallardo | |
| 2013/0160197 | A1* | 6/2013 | Conley | F24F 7/065 4/347 |
| 2014/0059750 | A1* | 3/2014 | Bochnik | A47K 13/307 4/209 R |
| 2014/0137317 | A1* | 5/2014 | Sollami | E03D 9/05 4/213 |
| 2014/0338111 | A1* | 11/2014 | Zheng | E03D 9/052 4/213 |
| 2014/0338114 | A1* | 11/2014 | Zheng | E03D 9/052 4/352 |
| 2015/0074886 | A1* | 3/2015 | Wu | E03D 9/052 4/213 |
| 2015/0107009 | A1* | 4/2015 | Quick | E03D 9/05 4/348 |
| 2015/0292189 | A1* | 10/2015 | Chavez | E03D 9/052 4/213 |
| 2016/0040415 | A1* | 2/2016 | Wafford | E03D 9/052 4/213 |
| 2016/0338556 | A1 | 11/2016 | Payziev | |
| 2017/0009440 | A1* | 1/2017 | Jun | E03D 11/13 |
| 2017/0014009 | A1* | 1/2017 | Smith | E03D 9/052 |
| 2018/0135287 | A1* | 5/2018 | Hall | B01D 53/30 |
| 2019/0053675 | A1* | 2/2019 | Shah | E03D 9/04 |
| 2019/0323221 | A1* | 10/2019 | Phonethepswath | E03D 9/05 |
| 2020/0141104 | A1* | 5/2020 | Caulder | A47K 13/307 |
| 2021/0101106 | A1* | 4/2021 | Clement | E03D 9/052 |

FOREIGN PATENT DOCUMENTS

| | | |
|---|---|---|
| CN | 201045212 | 4/2008 |
| CN | 201195870 | 1/2009 |
| EP | 0289696 | 11/1988 |
| EP | 3145380 | 3/2017 |
| JP | S6193576 | 6/1986 |
| JP | 2008/081928 | 4/2008 |
| JP | 2010227360 | 10/2010 |
| JP | 2013064235 | 4/2013 |
| JP | 2013192765 | 9/2019 |
| WO | 2014024522 | 2/2014 |
| WO | 2015179774 | 11/2015 |

OTHER PUBLICATIONS

EP Application No. 15729618.7, Summons to Attend Oral Proceedings pursuant to Rule 1151(1) EPC (Nov. 15, 2018).

EP Application No. 15729618.7, Communication under Rule 71(3), Intention to Grant dated Mar. 8, 2019.

International Report on Patentability of PCY/US2015/032196, Patent Cooperation Treaty, dated Dec. 1, 2016, International Searching Authority.

* cited by examiner

TOILET VENTILATION SYSTEM

TECHNICAL FIELD

The present disclosure relates to a toilet bowl ventilation system that vents air proximate to a toilet bowl. More specifically, the disclosure is directed to a toilet bowl ventilation system comprised of an odor exhaust system and a toilet having an interior cavity. The odor exhaust system has a housing disposed within the interior cavity, a ventilation inlet positioned proximate to the toilet bowl, a ventilation outlet configured to exhaust exterior to the housing, and a fan enclosed by the housing to move air from the area proximate to the toilet bowl through the housing and exhaust the air to an area exterior to the housing (e.g. outdoors).

BACKGROUND OF THE INVENTION

The disclosure relates to the field of restroom ventilation devices, and specifically to those devices coupled with or proximate to a toilet bowl.

Within the field of restroom ventilation devices, a distinct need exists for an apparatus which may efficiently exhaust the unpleasant odors and air which normally emanate from around a toilet, especially during and after use, thereby enhancing user comfort.

Numerous systems are known for exhausting air from a restroom. Systems which are mounted within a wall or ceiling are the most common. However, these known systems suffer from significant inefficiencies. Chief among those inefficiencies is the excessive room volume from which wall and ceiling-mounted systems must ventilate. Although the primary volume of concern exists at or near the toilet itself, wall and ceiling-mounted systems must draw air from the entire room, including the area occupying the space at and near the toilet.

Because of the large volume of air that known systems need to ventilate to be effective, known restroom ventilation systems fail to efficiently remove all air containing foul odors and thereby allow foul odors to linger or permeate the room. In order to be effective, traditional restroom ventilation systems require the ventilation of large quantities of air. To ventilate an effective amount of air to remove offensive odors rapidly, the speed and size of the room fan must be significant. Even then, the opportunities for pressure loss and air-flow resistance naturally increase with the size of the room such that the inefficiencies associated with ventilating large restrooms, including commercial restrooms, may be significantly multiplied over those existing in an average-sized residential restroom.

Moreover, removing air from the room does not prevent the user from being exposed to unpleasant smells or prevent users in adjacent stalls from being exposed to unpleasant smells emitted around a toilet associated with another user. Moreover, existing restroom ventilation systems are not energy efficient, because they increase the amount of conditioned air that needs to be supplied to the restroom by heating, ventilating, and cooling systems. Furthermore, because of the large room size and small air draw, the time to remove unpleasant odors from the toilet area may overlap between users, exposing a subsequent user to a prior user's odors.

A problem with filter-based ventilation systems that attempt to filter pungent air from around the toilet by recirculating air through a filter and back to the surrounding area is that the installation of a filter-based ventilation system generally requires mounting additional components to the toilet or seat. Adding additional components creates difficulty when users attempt to clean the inner portions of the components or any toilet surface proximate to the components because mounting additional components often creates small, hard to reach spaces for cleaning. Cleaning the toilet and seat is especially important in preventing the spread of germs and disease and in maintaining a clean appearance. Moreover, filter-based systems fail to effectively eliminate odors. Filters, such as those made from activated charcoal for example, are usually only able to remove up to 70% of the odors found in the air. The filters also become saturated over time, which results in a reduction in efficiency. Consequently, filters require replacement at the end of their useful lives, which increases the cost and time required to maintain the system.

A toilet ventilation system that is efficient, effective, and easy to clean is needed.

BRIEF SUMMARY OF THE INVENTION

An embodiment disclosed herein is a toilet bowl ventilation system. The toilet bowl ventilation system includes a toilet having a base and a bowl. The base includes an interior cavity. The toilet may include a water tank. The water tank may be configured to be disposed against a wall when the toilet is installed.

The toilet bowl ventilation system includes a housing disposed in the interior cavity. The housing may be releasably secured in the interior cavity. The housing may be entirely disposed within the base. The housing has a top wall, a bottom wall, and sidewalls that define an enclosed space within the housing. One or more of the top wall, the bottom wall, or the sidewalls may be selectively removable to access the enclosed space.

The toilet bowl ventilation system includes a ventilation inlet in gaseous communication with the enclosed space. The ventilation inlet may include a housing end and a toilet end. The toilet end may terminate proximate to the toilet, and the housing end may terminate within the enclosed space. An inlet ventilation hose may be in direct gaseous communication with the ventilation inlet.

The toilet bowl ventilation system includes a ventilation outlet in gaseous communication with the enclosed space. The ventilation outlet may include an outlet housing end and an outlet evacuation end. The outlet housing end may terminate within the enclosed space, and the outlet evacuation end may terminate external to the toilet. An output ventilation hose may be in direct gaseous communication with the ventilation outlet.

The toilet bowl ventilation system includes a fan positioned within the enclosed space. The fan may be a squirrel cage fan. The fan may be in direct gaseous communication with the ventilation outlet. The fan is operable to move air from the ventilation inlet through the enclosed space to the ventilation outlet in response to receiving power. A controller may be used for selectively providing power to the fan.

The toilet bowl ventilation system may include a seat assembly. The seat assembly may be disposed over the bowl and hingedly connected with the toilet. The seat assembly may include a body and a toilet seat. The body may include one or more intake inlets disposed in the body and in gaseous communication with the ventilation inlet. The toilet bowl ventilation system may include a first ventilation hose. The first ventilation hose may be in gaseous communication with the one or more intake inlets and the ventilation inlet.

The seat assembly may include one or more control buttons. The control buttons may be operable to selectively control power to the fan. The toilet bowl ventilation system may include a sensor which may be positioned on the seat assembly. The sensor may be operable to provide an activation signal to the controller indicative of a presence of a body on the toilet seat, wherein the controller may be operable to provide power to the fan when the activation signal indicates that the body is present on the toilet seat.

An embodiment disclosed herein is an odor exhaust system. The odor exhaust system may include the housing configured to be received in the interior cavity of the toilet. The odor exhaust system may include the ventilation inlet and the ventilation outlet. The odor exhaust system may include the fan positioned within the enclosed space. The fan may be operable to move air from the ventilation inlet through the enclosed space to the ventilation outlet in response to receiving power. The odor exhaust system may include the controller for selectively providing power to the fan.

DETAILED DESCRIPTION OF THE INVENTION

While the making and using of various embodiments of the present disclosure are discussed in detail below, it should be appreciated that the present disclosure provides many applicable inventive concepts that are embodied in a wide variety of specific contexts. The specific embodiments discussed herein are merely illustrative of specific ways to make and use the embodiment described and do not delimit the scope of the disclosure.

It will be understood that the particular embodiments described herein are shown by way of illustration and not as limitations of the disclosure. The principal features of this disclosure may be employed in various embodiments without departing from the scope of the disclosure. Those of ordinary skill in the art will recognize numerous equivalents to the specific procedures described herein. Such equivalents are considered to be within the scope of this disclosure and are covered by the claims.

Figure 1:
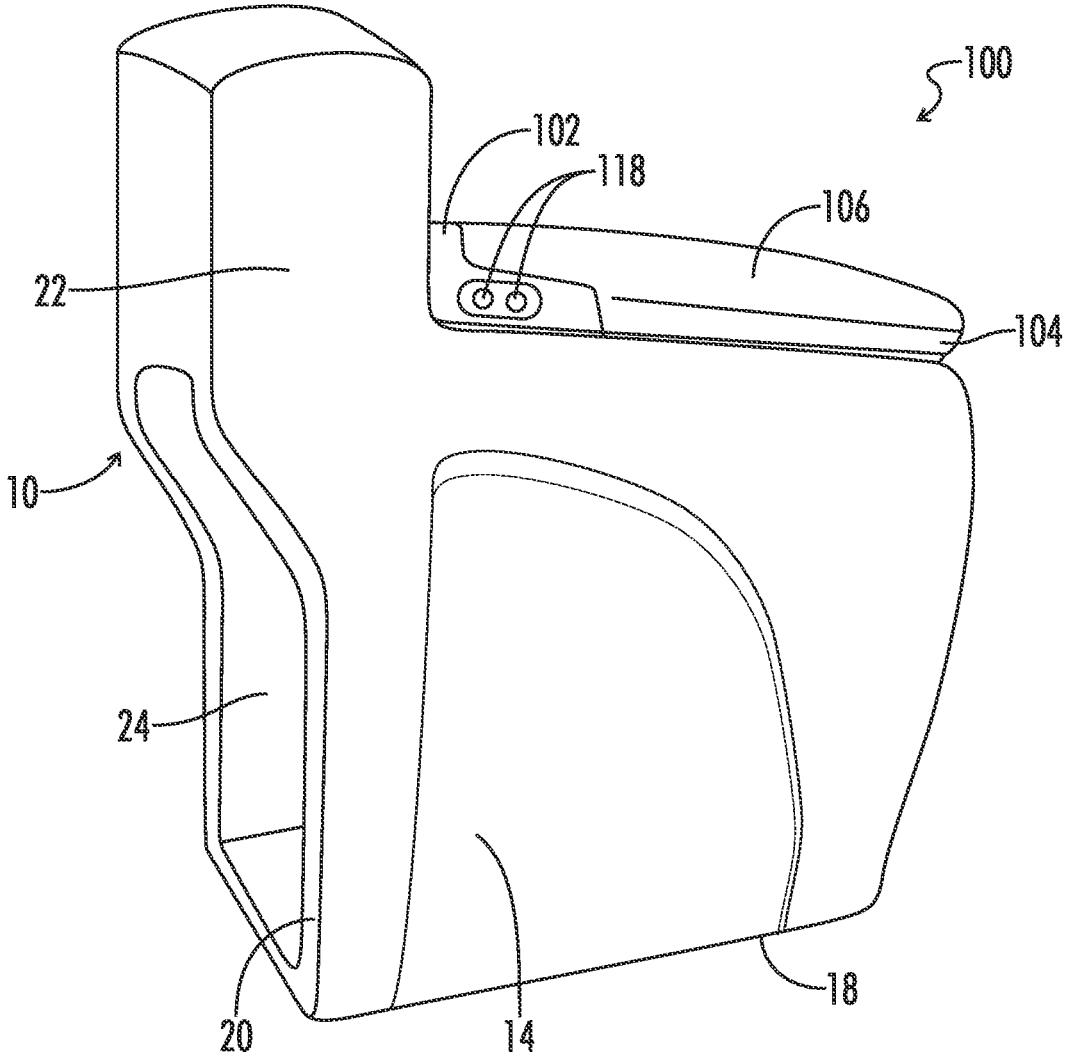
FIG. 1 is a side perspective view of an embodiment of a toilet bowl ventilation system.
Figure 2:
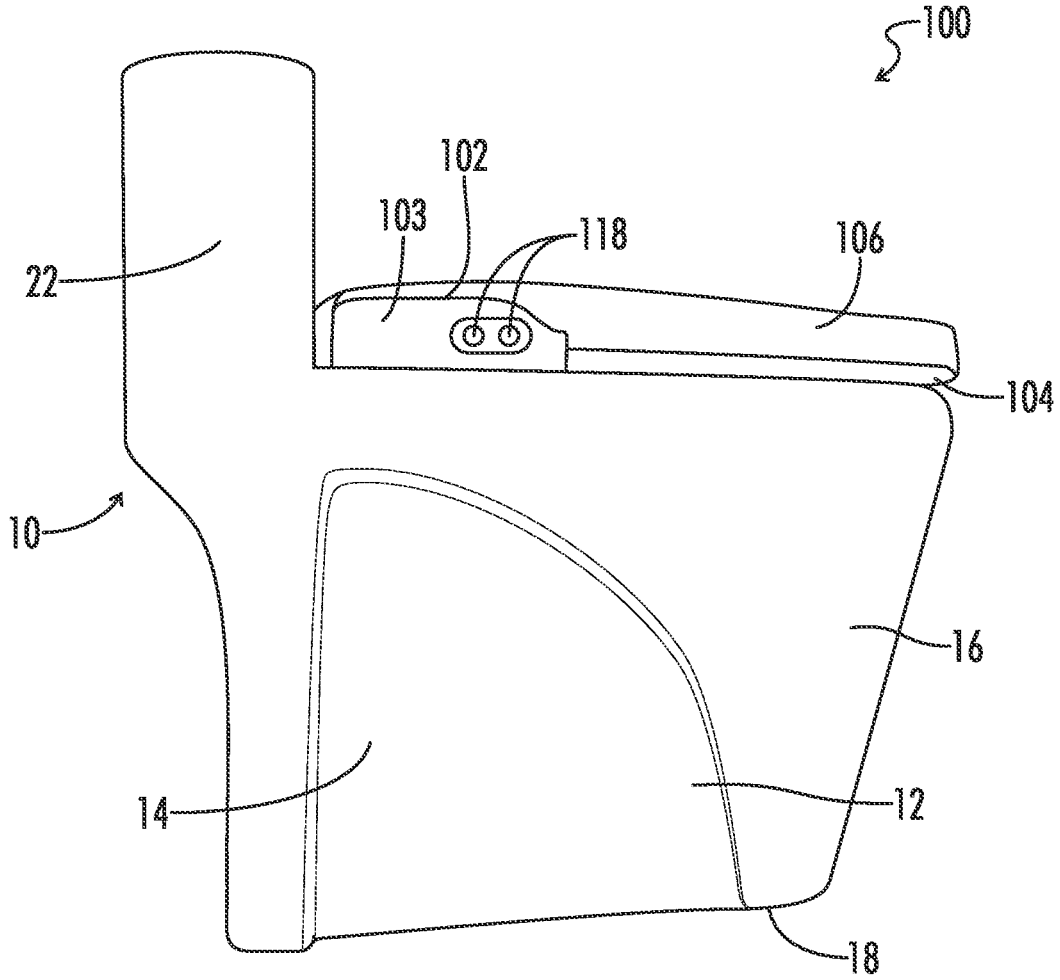
FIG. 2 is a side view of the toilet bowl ventilation system of FIG. 1.
Figure 3:
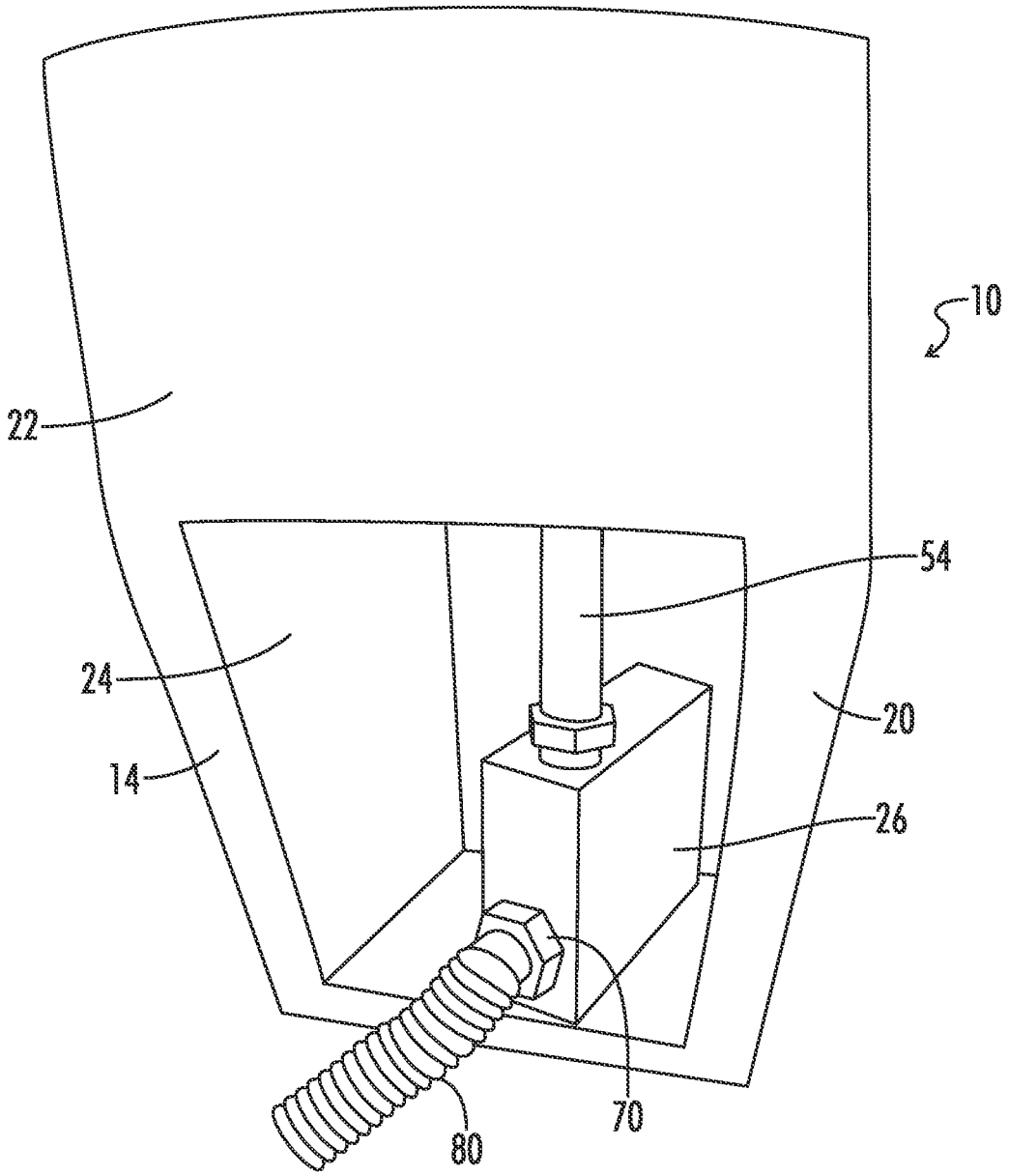
FIG. 3 is a rear perspective view of the toilet bowl ventilation system of FIG. 1.
Figure 4:
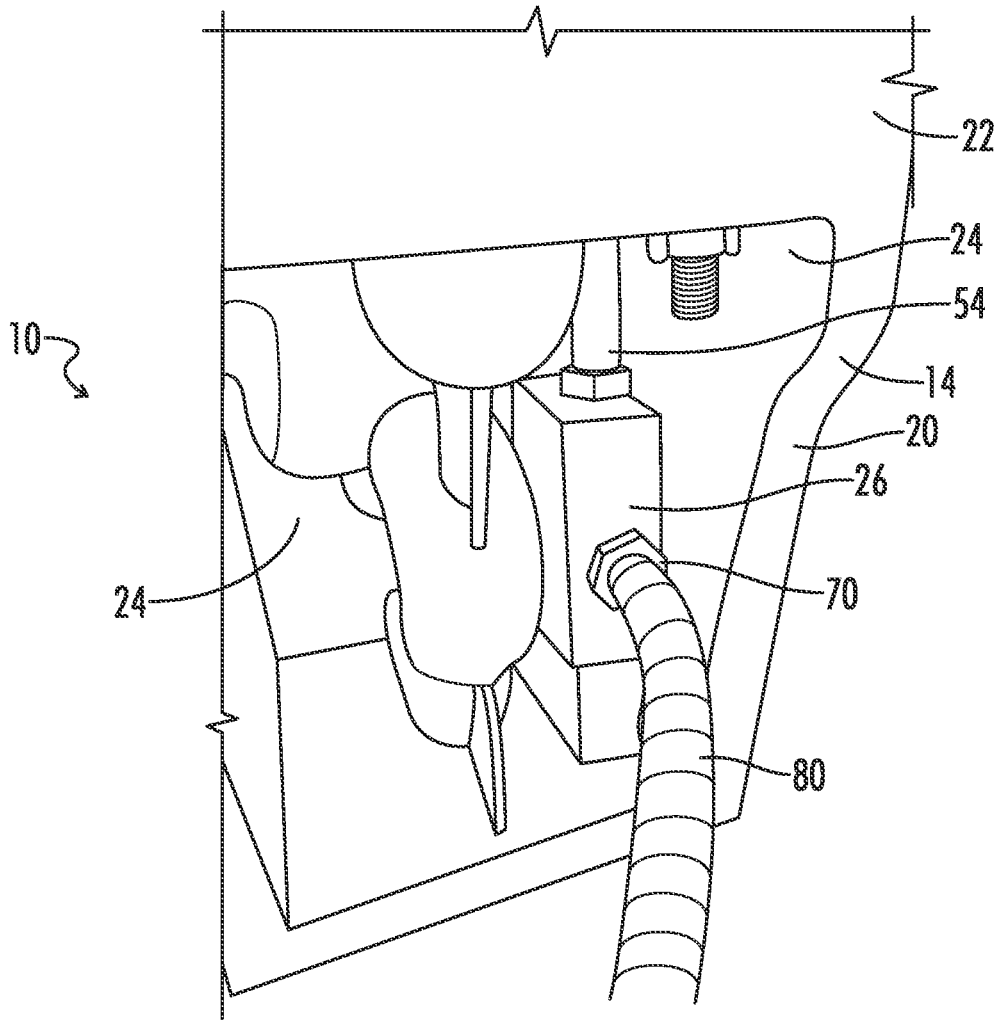
FIG. 4 is an additional rear perspective view of the toilet bowl ventilation system of FIG. 1.

An embodiment of a toilet bowl ventilation system 10 is shown in FIGS. 1-13. As shown in FIGS. 1 and 2, the toilet bowl ventilation system 10 includes a toilet 12. The toilet 12 includes a base 14 and a bowl 16. The base 14 includes a bottom toilet surface 18 and a rear toilet surface 20. The bottom toilet surface 18 is disposed toward the ground and may be secured against the ground, such as by floor bolts, to provide support for other components of the toilet 12. The bowl 16 may extend horizontally and vertically from the base 14, as illustrated in FIG. 2. The bowl 16 may contain the primary area of use such that a user may defecate or urinate into the bowl 16. The toilet 12 may include a water tank 22. The water tank 22 may extend upwardly from the base 14 to a height exceeding the height of the bowl 16. The water tank 22 may contain water and may replenish water to the bowl 16 after use (i.e. flushing). The water tank 22 may be configured to be flushly disposed against a wall of a structure, such as a room wall, when the toilet 12 is installed. As shown in FIGS. 3 and 4, the base 14 of the toilet 12 includes an interior cavity 24. The interior cavity 24 may be within the base 14 and open at the rear toilet surface 20 (FIG. 3), or other surface the toilet 12, so that the interior cavity 24 may be accessible from exterior to the toilet 12. The interior cavity 24 may be positioned toward the rear toilet surface 20 of the base 14 and below the water tank 22 such that the interior cavity 24 may be located away from a user but accessible for cleaning, and to receive a housing 26.

The housing 26 may be rectangular in profile and disposed within the interior cavity 24 of the base 14. The housing 26 may be entirely disposed within the base 14, as illustrated in FIG. 4. The housing 26 may be secured, such as by screws or adhesive, to the toilet 12. In some embodiments, the housing 26 may be releasably secured with the interior cavity 24. The term releasably secured means that the capability of removing a first feature, such as the housing 26, from a second feature, such as the interior cavity 24, is maintained, even after the first feature has been secured to the second feature, such as by latch or tongue and groove joint. Installing the housing 26 to be releasably secured may increase the ease of cleaning and effectiveness of the toilet bowl ventilation system 10 by allowing greater accessibility for cleaning and maintenance. For example, the housing 26 could be releasably secured within the interior cavity 24 by a hook and loop fastener to secure the housing 26 for operation or release the housing 26 for cleaning and maintenance.

Figure 6:
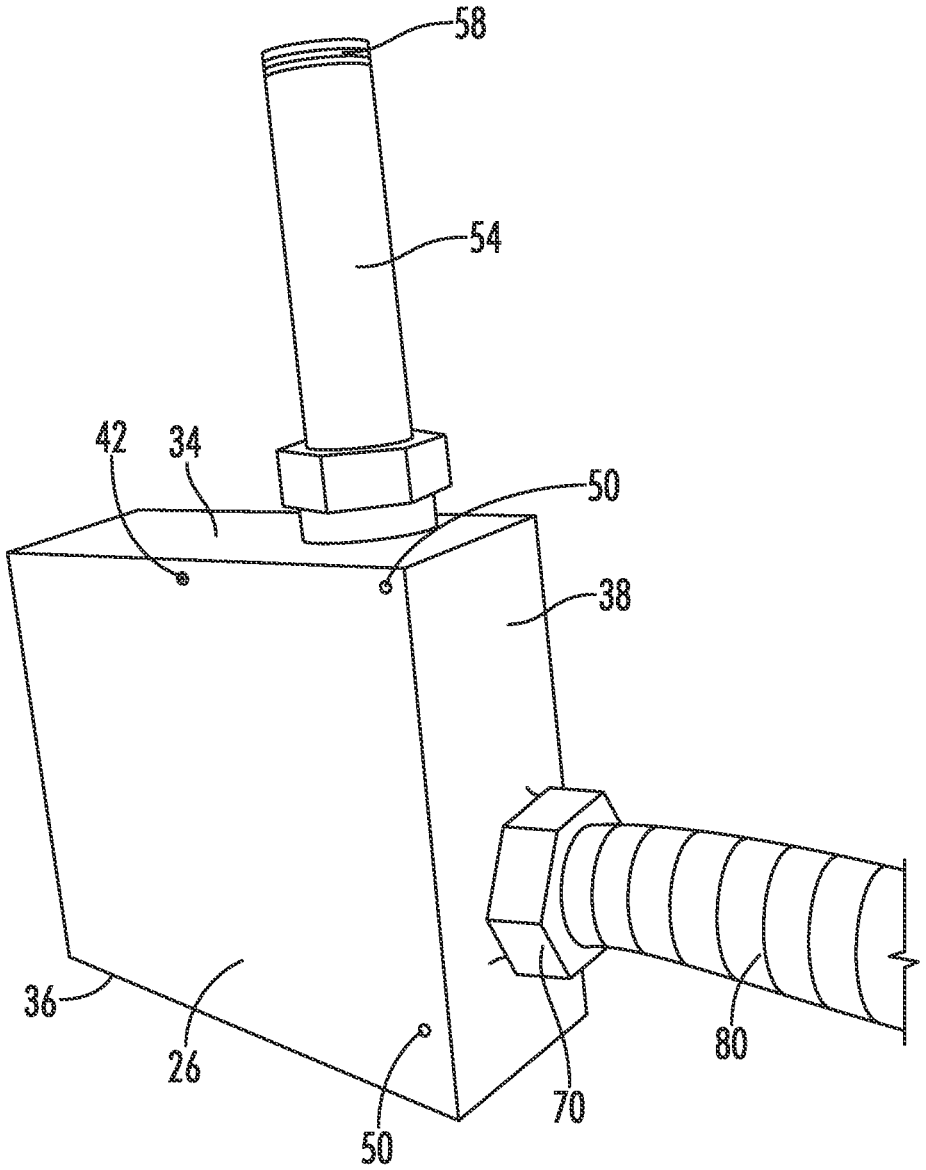
FIG. 6 is a top perspective view of a housing according to an embodiment of the toilet bowl ventilation system.
Figure 7:
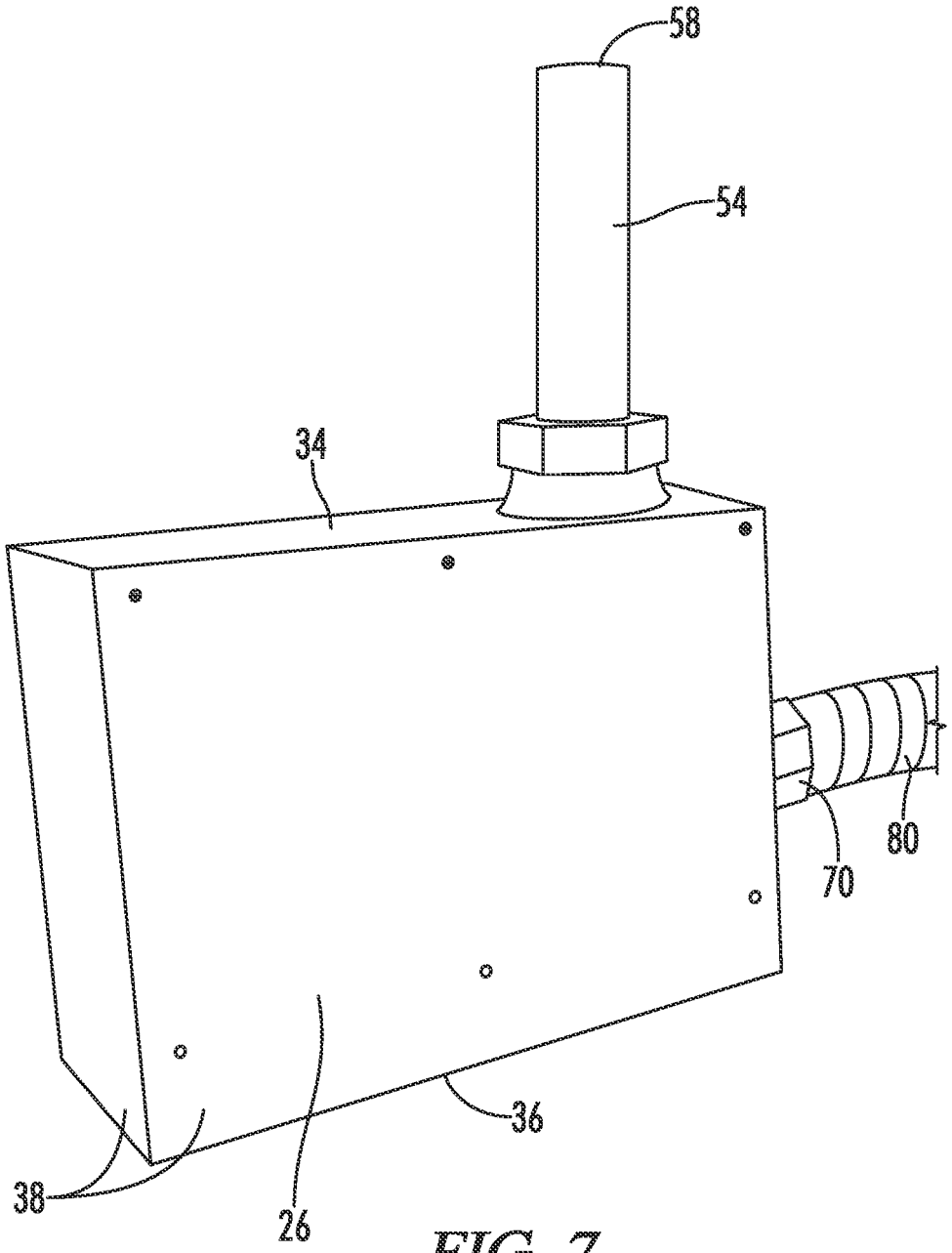
FIG. 7 is a bottom perspective view of the housing of FIG. 6.
Figure 8:
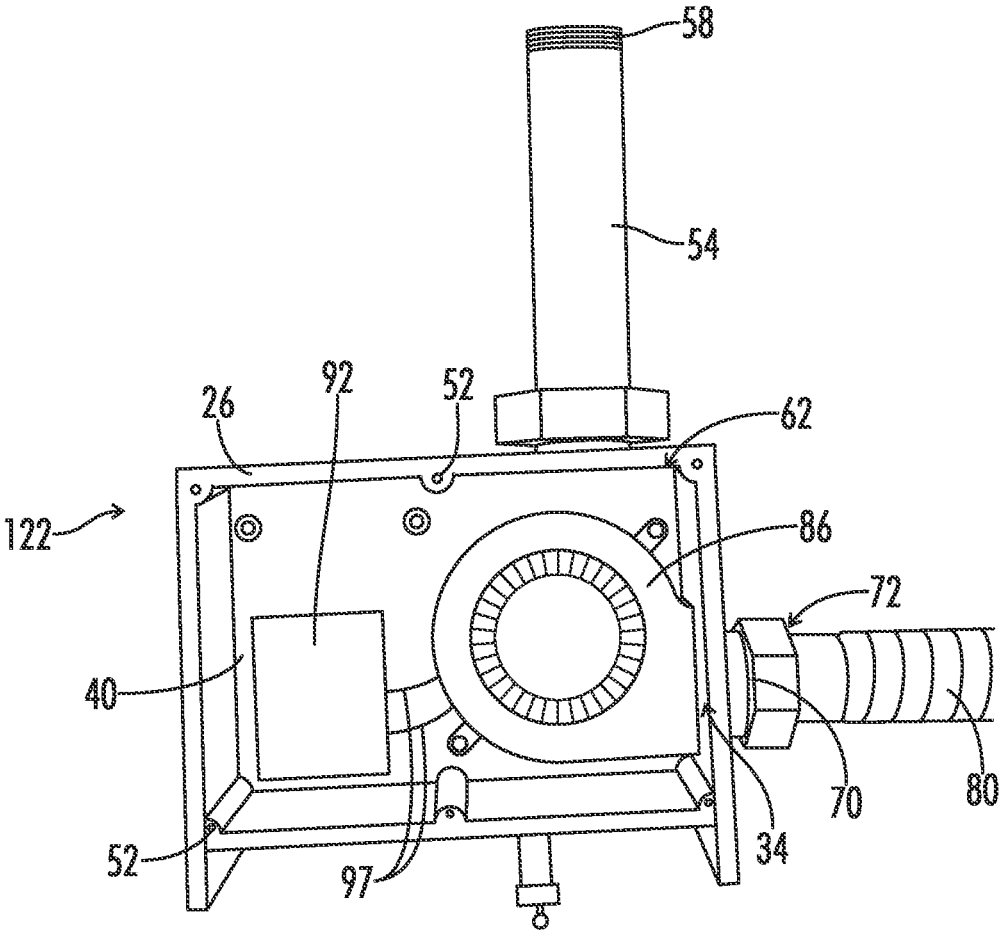
FIG. 8 is a side cross-sectional view of the housing of FIG. 6.
Figure 9:
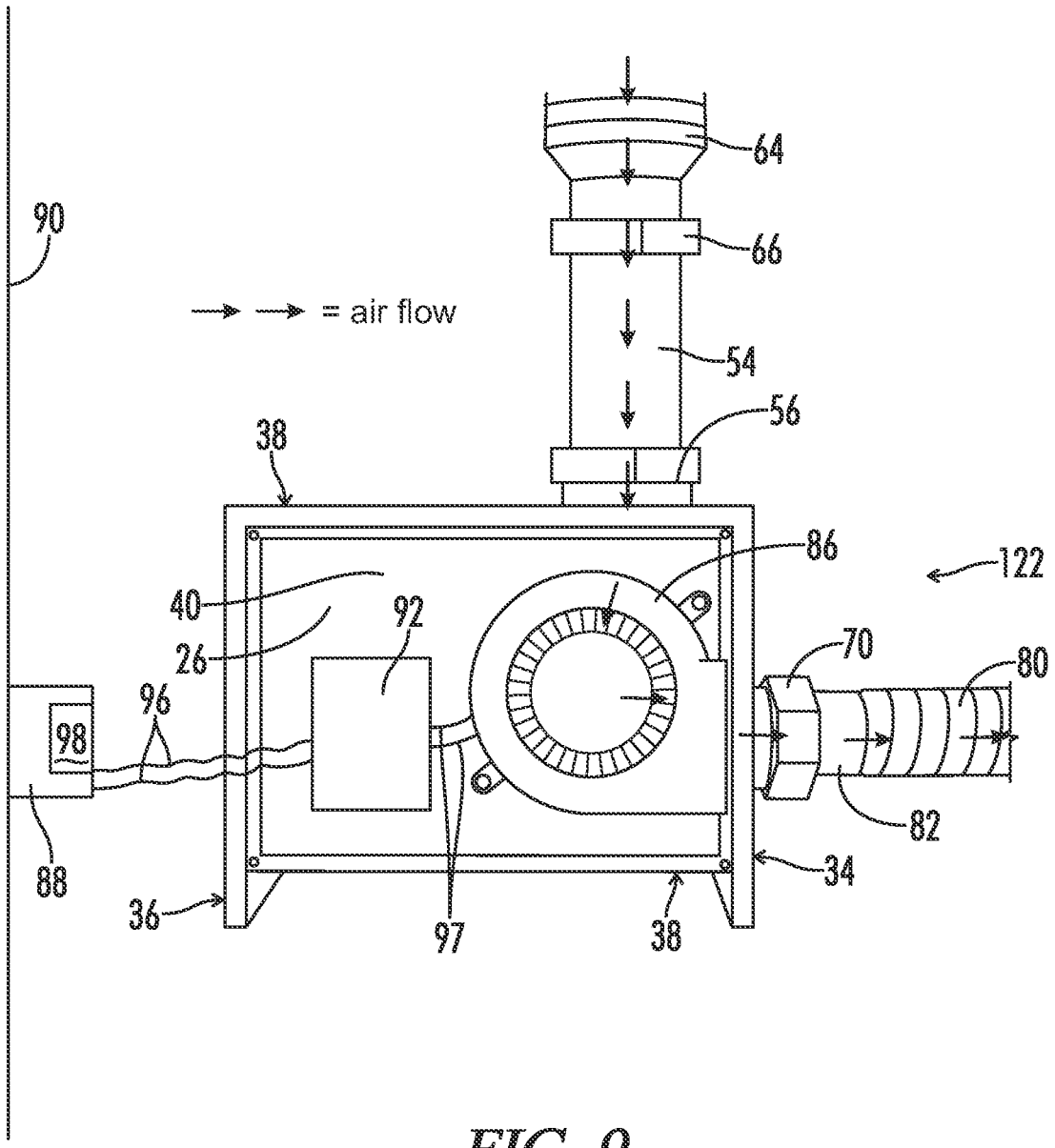
FIG. 9 is an additional cross-sectional view of the housing of FIG. 6.
Figure 10:
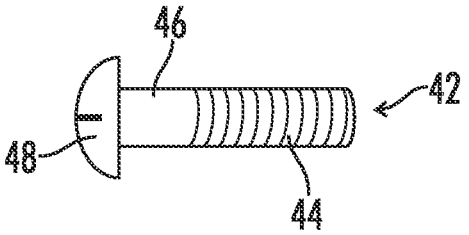
FIG. 10 is a side view of a screw.
Figure 11:
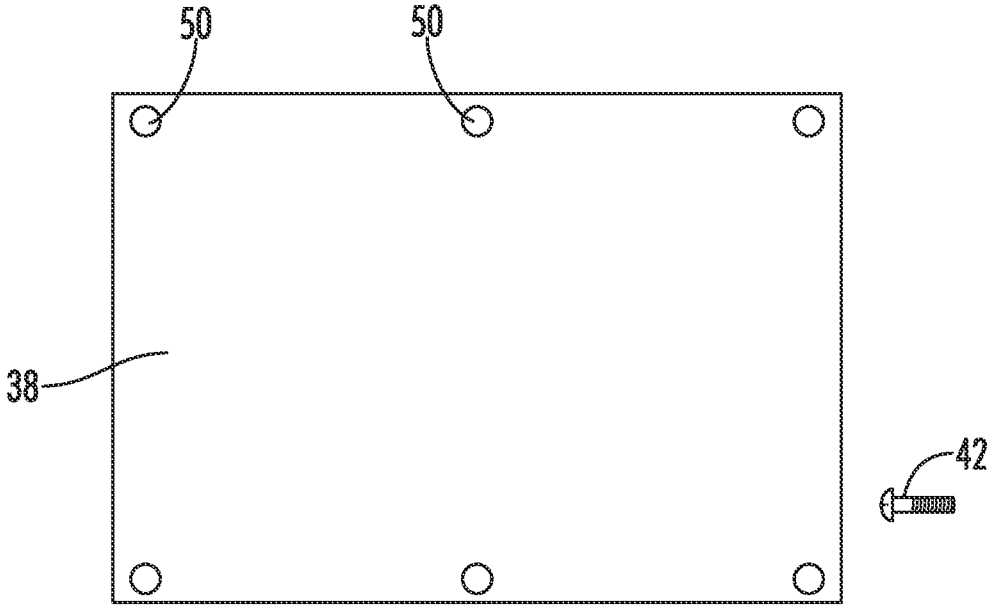
FIG. 11 is a front view of a sidewall according to an embodiment of the toilet bowl ventilation system.

The housing 26 may be comprised of a top wall 34, a bottom wall 36, and sidewalls 38, as shown in FIGS. 6 and 7. The walls 34, 36, and 38 may define an enclosed space 40, as illustrated in FIGS. 8 and 9. One or more of the top wall 34, the bottom wall 36, or the sidewalls 38 may be selectively removable to allow access to the enclosed space 40. The term selectively removable means that one or more of the walls 34, 36, or 38 retains the capability of being removed even after being disposed to the housing 26, such as by one or more screws 42. Installing one or more walls 34, 36, or 38 to be selectively removable may increase the ease of cleaning and effectiveness of the toilet bowl ventilation system 10 by providing user access to the enclosed space 40 for cleaning and maintenance. Each of the one or more screws 42 may include a threaded end 44, a cylindrical portion 46, and a head 48, as illustrated in FIG. 10. One or more of the walls 34, 36, or 38 may contain one or more holes 50 configured to receive the cylindrical portion 46 of the screws 42, as shown in FIG. 11. The housing 26 may contain one or more threaded holes 52, cooperatively threaded with the threaded end 44 of the screws 42, as illustrated in FIG. 9. Each screw 42 may be configured so that the threaded end 44 and cylindrical portion 46 may fit within and slide through the holes 50, the threaded portion 46 may be screwed into the threaded holes 52, and the head 48 may be larger in diameter than the holes 50 to prevent the screw 42 from passing completely through the hole 50. Each screw 42 may be configured so that the head 48 is disposed to one of the walls 34, 36, or 38 of the housing 26 when the screw 42 is completely fastened to secure one or more of the walls 34, 36, or 38.

Figure 12:
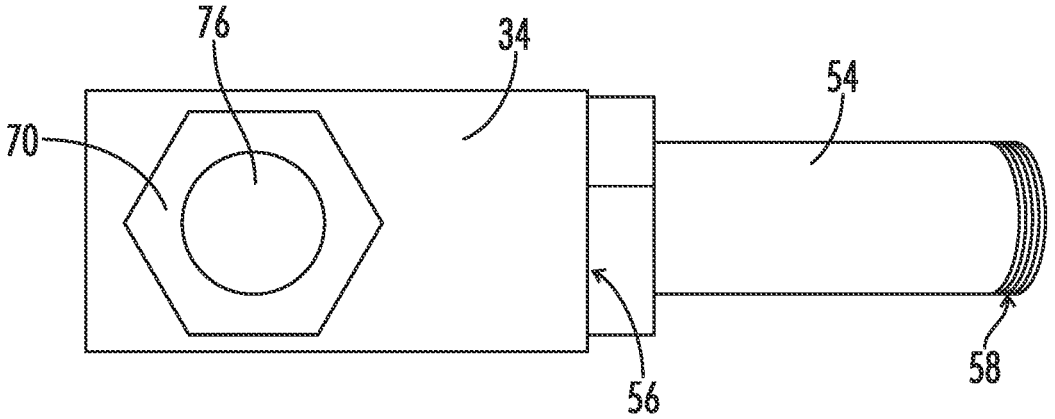
FIG. 12 is a top view of the housing of FIG. 6.

A ventilation inlet 54 is in gaseous communication with the enclosed space 40, as shown in FIGS. 8 and 9. The term gaseous communication means that air may flow freely between a first feature, such as the ventilation inlet 54, and a second feature, such as the enclosed space 40. The ventilation inlet 54 may be disposed in one of the walls 34, 36, or 38 of the housing 26, as illustrated in FIG. 9. The ventilation inlet 54 may include a housing end 56 and a toilet end 58, as shown in FIG. 12. The ventilation inlet 54 may be cylindrical in profile having a ventilation inlet aperture 60 (FIG. 13) to allow for air to flow through the ventilation inlet 54 from the housing end 56 and the toilet end 58. The housing end 56 may terminate within the enclosed space 40 of the housing 26, and the toilet end 58 may terminate proximate to the bowl 16. The ventilation inlet 54 may be positioned such that the housing end 56 terminates along a housing inner surface 62, as shown in FIG. 8. The ventilation inlet 54 may extend from the housing end 56, perpendicular to one of the sidewalls 38, until it terminates at the toilet end 58, as shown in FIG. 9. The toilet end 58 may be threaded (FIG. 12) to allow for a cooperative engagement with an inlet hose 64, as shown in FIG. 9.

The inlet hose 64 includes an inlet hose housing end 66 and an inlet hose toilet end 68. The inlet hose housing end 66 may be disposed on the toilet end 58 of the ventilation inlet 54, and the inlet hose 64 may extend a distance from the ventilation inlet 54, as illustrated in FIGS. 8 and 9. The inlet hose 64 may have an elongated profile, which allows for air to travel from the inlet hose housing end 66 and the inlet hose toilet end 68. The inlet hose 64 may be configured to be in direct gaseous communication with the ventilation inlet 54. The term direct means that one feature, such as the inlet hose 64, is in an uninterrupted connection with a second feature, such as the ventilation inlet 54. The direct gaseous communication between the inlet hose 64 and the ventilation inlet 54 may allow air to travel from proximate to the inlet hose toilet end 68 directly through the ventilation inlet 54 and into the enclosed space 40. The inlet hose toilet end 68 may be disposed proximate to the toilet bowl 16, which may increase the efficiency and effectiveness of the toilet ventilation system 10 by allowing the toilet bowl ventilation system 10 to draw air from proximate to the toilet bowl 16 before the pungent air completely dissipates to surrounding areas (e.g. throughout a restroom).

Figure 13:
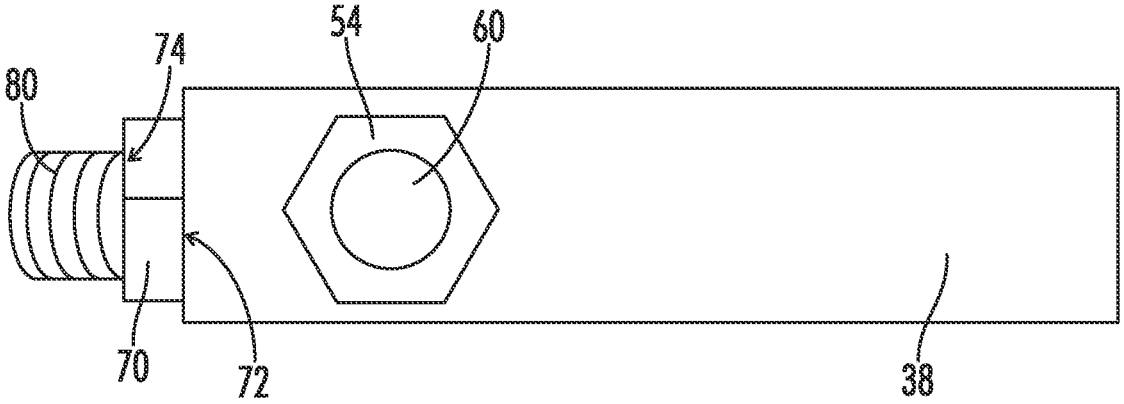
FIG. 13 is a side view of the housing of FIG. 6.

A ventilation outlet 70 is in gaseous communication with the enclosed space 40. The ventilation outlet 70 may be disposed in a sidewall 38 of the housing 26, as shown in FIGS. 6 and 8. The ventilation outlet 70 may include an outlet housing end 72 and an outlet evacuation end 74, as illustrated in FIG. 13. The ventilation outlet 70 may have a cylindrical profile having an outlet aperture 76 (FIG. 12) to allow air to travel through the ventilation outlet 70 from the outlet housing end 72 and the outlet evacuation end 74. The outlet housing end 72 may terminate within the enclosed space 40 of the housing 26, and the outlet evacuation end 74 may terminate exterior to the housing 26. The ventilation outlet 70 may be positioned such that the outlet housing end 72 terminates along the housing inner surface 62 and the enclosed space 40, as shown in FIG. 9. An output ventilation hose 80 may be disposed on the outlet evacuation end 74 of the ventilation outlet 70 (FIGS. 8 and 9) and may extend a distance to allow for exhaust of pungent air at a distance from the toilet 12 (e.g. outdoors). The output ventilation hose 80 may include an output housing end 82 and an output exhaust end 84. The output ventilation hose 80 may have an elongated profile, which allows for air to travel from the output housing end 82 and the output exhaust end 84. The output ventilation hose 80 may be configured to be in direct gaseous communication with the ventilation outlet 70 such that air may flow from around the ventilation inlet 54 through the enclosed space 40 and exterior to the output ventilation hose 80. The output ventilation hose 80 may increase the effectiveness of the toilet bowl ventilation system 10 by exhausting pungent air away from where a user is located to remove offensive odors.

A fan 86 is disposed within the enclosed space 40 of the housing 26, as illustrated in FIGS. 8 and 9. The fan 86 may be oriented so that it is in direct gaseous communication with the ventilation outlet 70 and the enclosed space 40. The fan 86 may be configured so that it draws air from the enclosed space 40 of the housing 26. The fan 86 is operable to draw air from the enclosed space 40 and transport the air through the ventilation outlet 70. The positioning of the fan 86 within the enclosed space 40 may allow the fan 86 to only draw air from the enclosed space 40 rather than an entire room, thereby increasing the effectiveness and efficiency of the toilet bowl ventilation system 10. The operation of the fan 86 may create a pressure differential between the enclosed space 40 and the toilet end 58 of the ventilation inlet 54, which may cause air to flow from around the bowl 16 through the ventilation inlet 54 and into the enclosed space 40 to replace the air previously exhausted by the fan 86. The fan 86 may exhaust the air that was drawn from around the bowl 16, and the pressure differential may draw more air through the ventilation inlet 54 for so long as the fan 86 operates.

The pressure differential from the operation of the fan 86 may cause air to flow along a path, as illustrated in FIG. 9. Air proximate to the toilet bowl 16 may flow into the inlet hose 64 through the inlet hose toilet end 68. Air from the inlet hose 64 may flow into the ventilation inlet 54 through the toilet end 58 of the ventilation inlet 54. Air from the ventilation inlet 54 may flow into the enclosed space 40 through the housing end 56 of the ventilation inlet 54. Air from the enclosed space 40 may flow into the fan 86. Air from the fan 86 may flow into the ventilation outlet 70 through the outlet housing end 72 of the ventilation outlet 70. Air from the ventilation outlet 70 may flow into the output ventilation hose 80 through the output housing end 82 of the output ventilation hose 80. Air from the output ventilation hose 80 may exhaust through the output exhaust end 84 of the output ventilation hose 80 and exterior to the toilet bowl ventilation system 10 (e.g. outdoors).

The fan 86 may be a squirrel cage fan. Electrical wires 96 may be used to connect the fan 86 to a motherboard 92 to operatively control the fan 86, such as selectively operating the fan 86. The electrical wires 96 may extend from the motherboard 92, through the enclosed space 40, and to the fan 86 (FIGS. 8 and 9). The motherboard 92 may be capable of providing an activation signal to the fan 86, thereby initiating operation of the fan 86. The motherboard 92 may be positioned within the enclosed space 40, as illustrated in FIGS. 8 and 9. The motherboard 92 may be secured, such as by screws or adhesive, to the housing 26.

Figure 5:
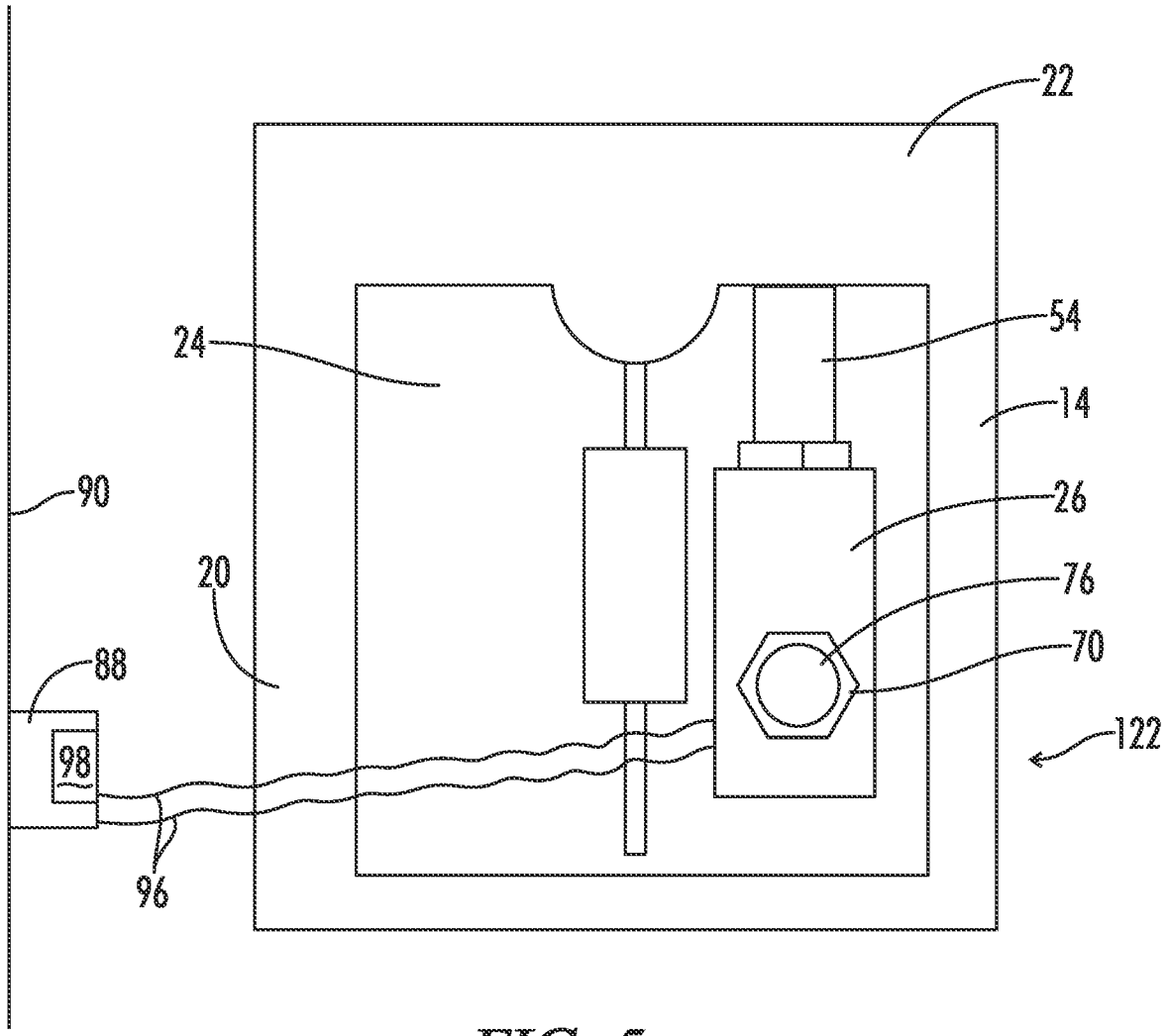
FIG. 5 is a rear view of the toilet bowl ventilation system of FIG. 1.

The motherboard 92 may be powered by a power supply 88. Power supply wires 97 may be used to connect the motherboard 92 to the power supply 88. The power supply 88 may be positioned outside the toilet bowl ventilation system 10. For example, the power supply 88 may be disposed on a room wall 90 adjacent to the toilet bowl ventilation system 10, as shown in FIGS. 5 and 9. Such a placement may be advantageous in that minimizes the possibility of water from the toilet 12 coming into contact with the power supply 80.

A controller 98 may be used to selectively control the distribution of power to the fan 86. The controller 98 may be embedded within the power supply 88 (FIGS. 5 and 9) or be disposed exterior to the power supply 88. In some embodiments, the controller 98 may be disposed on the motherboard 92.

Figure 14:
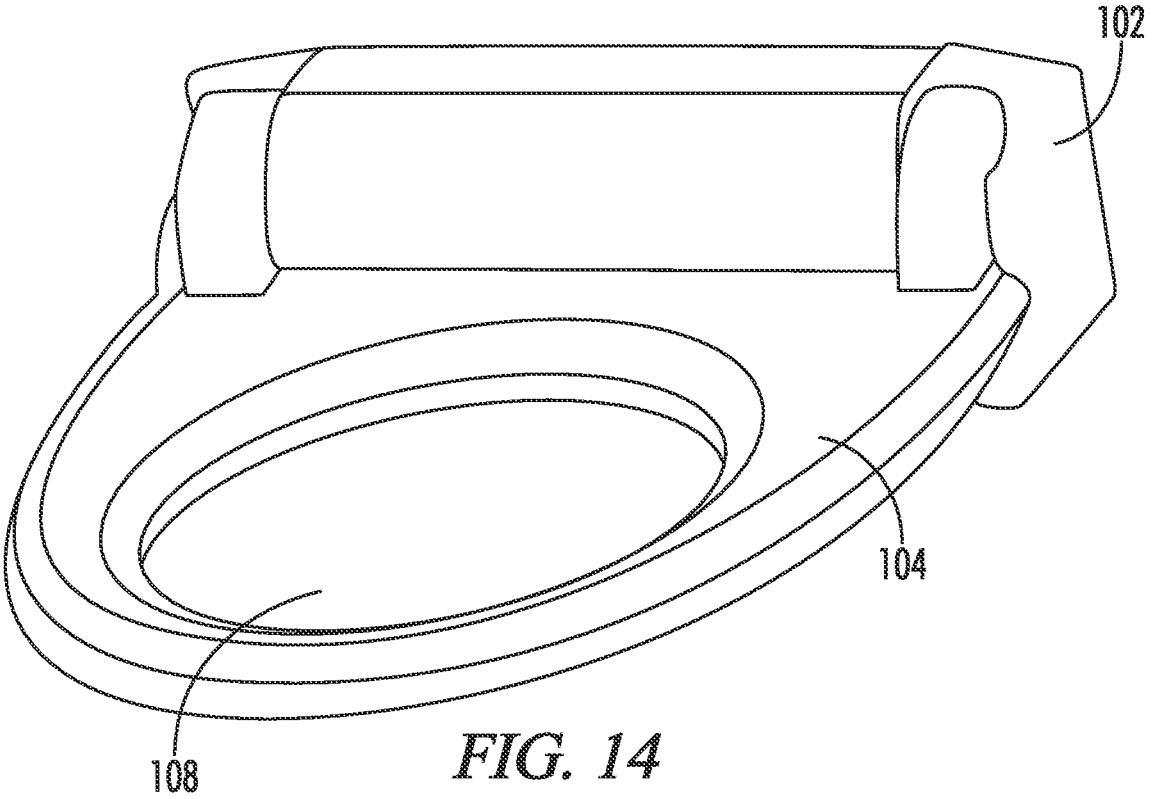
FIG. 14 is an isometric view of a toilet seat according to an embodiment of the toilet bowl ventilation system.
Figure 15:
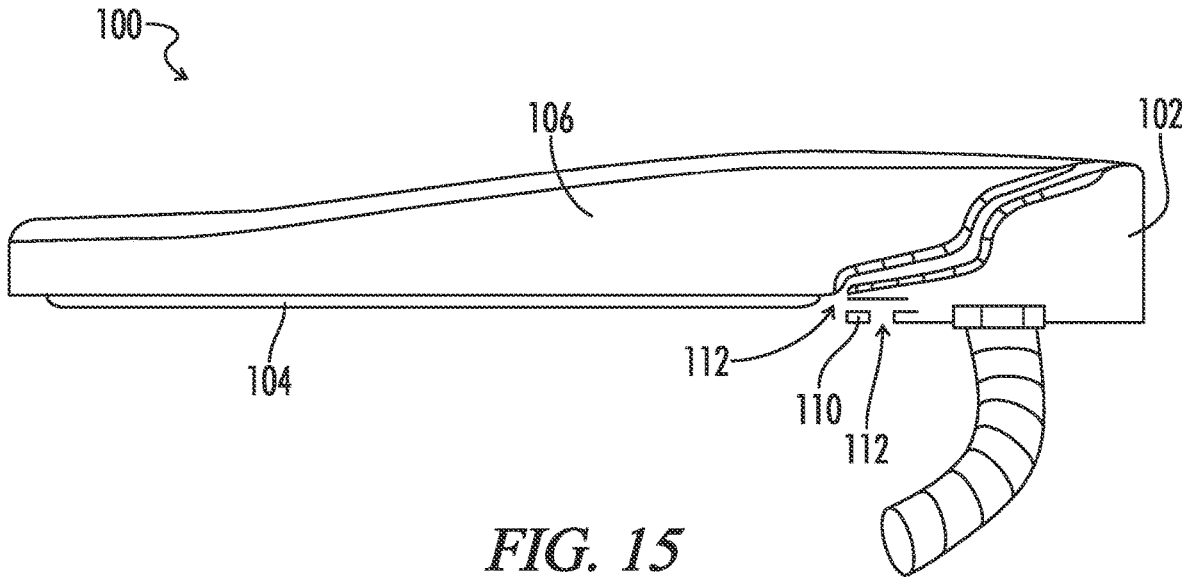
FIG. 15 is a side cross-sectional view of a seat assembly according to an embodiment of the toilet bowl ventilation system.

The toilet bowl ventilation system 10 may include a seat assembly 100. The seat assembly 100 may be disposed over the bowl 16, as shown in FIG. 2. The seat assembly 100 may contain a body 102, which may be connected to the base 14 of the toilet 12. As shown in FIG. 14, the body 102 may be hingedly connected to a toilet seat 104. The toilet seat 104 may be hingedly connected by being fastened to allow for the toilet seat 104 to rotate approximately 90 degrees, so that it may be disposed between an upright position and a down position. The body 102 may be hingedly connected to a seat cover 106. The seat cover 106 may conceal a seat opening 108 of the toilet seat 104 when the toilet 12 is not in use. The body 102 may contain one or more intake inlets 110, as shown in FIG. 15. The one or more intake inlets 110 may be positioned proximate to the toilet bowl 16 to allow for the intake of pungent air. The one or more intake inlets 110 may include one or more intake apertures 112 to allow for air to travel from the bowl 16 through the intake inlets 110. The one or more intake inlets 110 may be configured to be in gaseous communication with a seat ventilation outlet 114. The seat ventilation outlet 114 may be positioned proximate to the toilet bowl 16 (FIG. 15). As shown in FIG. 15, the seat ventilation hose 116 may be attached to the ventilation outlet 114. The seat ventilation hose 116 may be configured to establish a gaseous communication between the one or more intake inlets 110 and the ventilation inlet 54 of the housing 26. The gaseous communication between the seat ventilation hose 116 and the one or more intake inlets 110 may allow for the fan 86 to draw air from the one or more intake inlets 110 through the enclosed space 40 and exterior to the ventilation outlet 70 to effectively exhaust pungent air.

Figure 16:
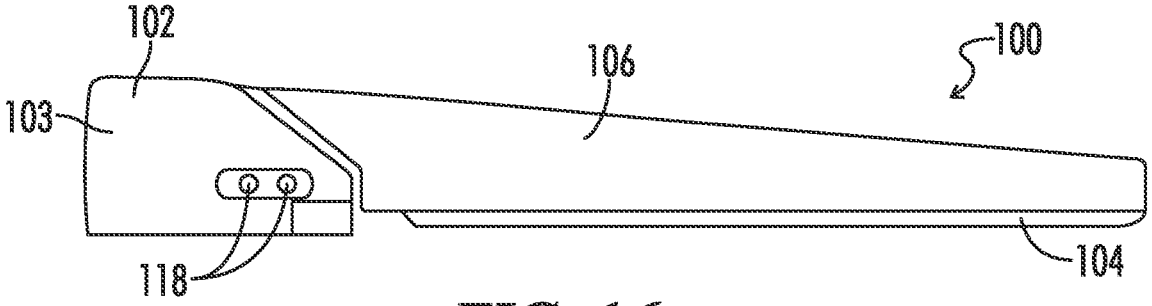
FIG. 16 is a side view of the seat assembly of FIG. 15.

Activation devices may be positioned on a seat assembly 100 to direct the controller 98 when to transfer power from the power supply 88 to the motherboard 92, which then activates, or powers, the fan 86. One or more buttons 118 may be disposed on the exterior body surface 103 of the body 102, as shown in FIGS. 2 and 16. The one or more buttons 118 may allow for a user to manually select and control operation of the fan 86. Upon user input, the one or more buttons 118 may direct the controller 98 to supply power from the power supply 88 to the fan 86. In some embodiments, the one or more buttons 118 may be operable to communicate with the controller 98 to direct the fan 86 to operate at varying speeds (e.g. low, medium, and high). Similarly, the one or more buttons 118 may direct the controller 98 to stop the power supply 88 from transmitting power to the fan 86 to conserve energy when the toilet 12 is not in use. A sensor 120 may be disposed on the seat assembly 100, such as on the exterior body surface 103, as illustrated in FIG. 14. The sensor 120 may allow for the automated control of the fan 86 to increase the efficiency of the toilet bowl ventilation system 10 by selectively operating the fan 86 when the toilet 12 is in use. The sensor 120 may be positioned (FIG. 16) to detect the presence of a user during use, such as by detecting any weight of a user that exceeds a predetermined weight threshold. Upon detection of a user, the sensor 120 may be operable to communicate the presence of the user with the controller 98 to direct the fan 86 to operate. Similarly, the sensor 120 may direct the controller 98 to stop the power supply 88 from transmitting power to the fan 86 to conserve energy when the sensor 120 does not detect the presence of a user (e.g., when the sensor 120 does not detect a weight that exceeds a predetermined weight threshold).

In an embodiment, an odor exhaust system 122 is shown in FIGS. 8 and 9. The odor exhaust system 122 may include the housing 26 including the enclosed space 40, the housing 26 configured to be received in the interior cavity 40 of the toilet 12. The odor exhaust system 122 may contain the ventilation inlet 54 and the ventilation outlet 70. The inlet hose 64 may be configured to the toilet end 58 of the ventilation inlet 54 such that the inlet hose 64 is in direct gaseous communication with the ventilation inlet 54. The output ventilation hose 80 may be configured to the outlet evacuation end 74 of the ventilation outlet 70 such that the output ventilation hose 80 is in direct gaseous communication with the ventilation outlet 70. The odor exhaust system 122 may include the fan 86 positioned within the enclosed space 40, as shown in FIG. 8. The fan 86 may be operable to move air from the ventilation inlet 54 through the enclosed space 40 to the ventilation outlet 70 in response to receiving power to transport pungent air. The odor exhaust system 122 may include the controller 98 to selectively provide power to the fan 86.

Figure 17:
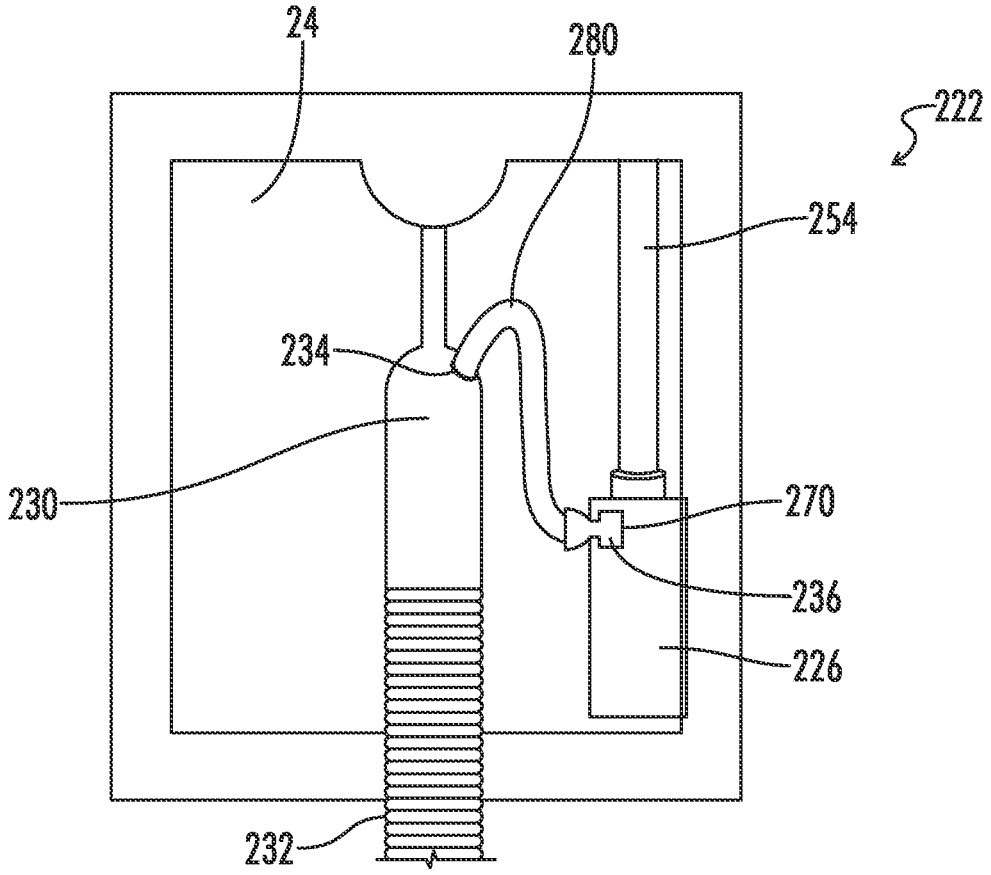
FIG. 17 is a rear elevation view of another embodiment of a toilet bowl ventilation system.

FIG. 17 depicts another embodiment of an odor exhaust system 222. A toilet includes internal outflow plumbing 230 that receives flushed water and waste. The internal outflow plumbing 230 connects to a pipe or plumbing 232 that conveys such water and waste to general sewage. The pipe 232 may be solid or flexible. The internal outflow plumbing 230 may include a sealed pipe joint 234 that receives an output ventilation hose 280.

A ventilation inlet 254 connects to housing 226. The interior of the housing 226 is generally configured in any manner as described with reference to FIGS. 5-9. The housing 226 has a ventilation outlet 270. As shown in FIG. 17, an air check valve 236 is connected to the ventilation outlet 270 at an upstream end of the air check valve 236. In the embodiment depicted in FIG. 17, the ventilation hose 280 connects into the downstream end of the check valve 236.

A check valve allows for one-way airflow out of the housing 226 but blocks airflow (and/or water and sewage flow) going in the reverse direction into the housing 226. A check valve has two ends, an inlet end and an outlet end. In some embodiments, the check valve 236 operates mechanically. Such a check valve is typically closed to prevent airflow. When air pressure builds up on the upstream end, the valve is forced open to permit air to flow through the valve and out the downstream end. When the air pressure is released, the valve closes again. In the embodiment of FIG.

17, air pressure may be increased in the downstream end of the check valve 236 when the fan 86 is operating to move air from the ventilation inlet 254 to the ventilation outlet 270. In other embodiments, the check valve 236 may be electronically controlled, such as by the controller 98 operating the fan 86, to open and permit airflow when the fan 86 is actively blowing air, and to close when the fan 86 is turned off.

As depicted in FIG. 17, the check valve 236 is connected directly to the ventilation outlet 270. Such a configuration permits direct access to the valve 236 or the housing 226 in the event that maintenance or repair work is necessary. When the check valve 236 is located as shown in FIG. 17 (connected to the ventilation outlet 270), the ventilation hose 280 may be coiled in such a way that a portion of the ventilation hose 280 is higher than the joint 234. In some embodiments, the ventilation hose 280 may be coiled such that a portion of the ventilation hose 280 is higher than the internal outflow plumbing 230 (FIG. 17). This coiled configuration prevents water and waste from entering to into the ventilation hose 280 and backing up to the check valve 236 and possibly into the housing 226. The coiled configuration of the ventilation hose 280 may be maintained by securing the ventilation hose 280 in place, such as by fastener or adhesive, to the interior cavity 24 to prevent the ventilation hose 280 from uncoiling.

In another embodiment, the check valve 236 may be connected at the joint 234. In such an embodiment, the ventilation hose 280 connects directly to the ventilation outlet 270 of the housing 226 on a first end, and connects to the upstream side of the check valve 236 on the second end.

While FIG. 17 shows the check valve 236 outside the housing 226, in other embodiments the check valve may be located inside the housing 226.

A list of non-exclusive example embodiments are provided below.

In one embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. A seat assembly is disposed over the bowl and hingedly connected with the toilet. The seat assembly has a body, and a toilet seat, and one or more intake inlets disposed in the body and in gaseous communication with the ventilation inlet.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. A seat assembly is disposed over the bowl and hingedly connected with the toilet. The seat assembly has a body, and a toilet seat, and one or more intake inlets disposed in the body and in gaseous communication with the ventilation inlet. A first ventilation hose is in gaseous communication with the one or more intake inlets and the ventilation inlet.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. A seat assembly is disposed over the bowl and hingedly connected with the toilet. The seat assembly has a body, and a toilet seat, and one or more intake inlets disposed in the body and in gaseous communication with the ventilation inlet. The seat assembly also has one or more buttons to selectively control power to the fan.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. An output ventilation hose is in gaseous communication with the ventilation outlet.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. A sensor is positioned on the seat assembly and operable to provide an activation signal to the controller indicative of a presence of a body on the toilet seat. The controller is operable to provide power to the fan when the activation signal indicates that the body is present on the toilet seat.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. One or more of the top, the bottom, and the side walls are selectively removable for accessing the enclosed space.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. The housing is entirely disposed within the base.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. The toilet includes a water tank. The water tank is configured to be disposed against a wall when the toilet is installed.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. The fan is a squirrel cage fan.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. The housing is releasably secured in the interior cavity.

In another embodiment, a toilet bowl ventilation system is provided, having a toilet including a base and a bowl. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space. A fan is positioned within the enclosed space. The fan is operable to move air from the ventilation inlet through the enclosed space to the ventilation outlet in response to receiving power. A controller is provided to selectively provide power to the fan. The fan is in direct gaseous communication with the ventilation outlet.

In another embodiment, a toilet bowl ventilation system is provided, having a toilet including a base, a bowl, and an internal pipe in fluid communication with the bowl and connected to a sewage pipe. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space and the sewage pipe. A fan is positioned within the enclosed space. The fan is operable to move air from the ventilation inlet through the enclosed space to the ventilation outlet in response to receiving power. A controller is provided to selectively provide power to the fan. A check valve is provided at the ventilation outlet of the enclosed space.

In another embodiment, a toilet bowl ventilation system is provided, having a toilet including a base, a bowl, and an internal pipe in fluid communication with the bowl and connected to a sewage pipe. The base includes an interior cavity. A housing is disposed within the interior cavity. The housing has a top, a bottom, and sidewalls defining an enclosed space. A ventilation inlet is in gaseous communication with the enclosed space. A ventilation outlet is also in gaseous communication with the enclosed space and the sewage pipe. A fan is positioned within the enclosed space. The fan is operable to move air from the ventilation inlet through the enclosed space to the ventilation outlet in response to receiving power. A controller is provided to selectively provide power to the fan. A check valve is provided at joint between the sewage pipe and the ventilation outlet.

In another embodiment a toilet odor exhaust system is provided. The toilet odor exhaust system has a housing configured to be received in an interior cavity of a toilet. The housing has a top, a bottom, and side walls defining an enclosed space. The housing has a ventilation inlet including a housing end and a toilet end. The toilet end terminates proximate to the toilet and the housing end terminates at the enclosed space. The housing has a ventilation outlet including an outlet housing end and an outlet evacuation end. The housing end of the ventilation outlet terminates at the enclosed space and the evacuation end of the ventilation outlet terminates external to the toilet. A fan is positioned within the enclosed space, the fan operable to move air from the ventilation inlet through the enclosed space to the ventilation outlet in response to receiving power. A controller is provided for selectively providing power to the fan.

In another embodiment a toilet odor exhaust system is provided. The toilet odor exhaust system has a housing configured to be received in an interior cavity of a toilet. The housing has a top, a bottom, and side walls defining an enclosed space. The housing has a ventilation inlet including a housing end and a toilet end. The toilet end terminates proximate to the toilet and the housing end terminates at the enclosed space. The housing has a ventilation outlet including an outlet housing end and an outlet evacuation end. The housing end of the ventilation outlet terminates at the enclosed space and the evacuation end of the ventilation outlet terminates external to the toilet. A fan is positioned within the enclosed space, the fan operable to move air from the ventilation inlet through the enclosed space to the ventilation outlet in response to receiving power. A controller is provided for selectively providing power to the fan. An inlet hose is in direct gaseous communication with the ventilation inlet.

In another embodiment a toilet odor exhaust system is provided. The toilet odor exhaust system has a housing configured to be received in an interior cavity of a toilet. The housing has a top, a bottom, and side walls defining an enclosed space. The housing has a ventilation inlet including a housing end and a toilet end. The toilet end terminates proximate to the toilet and the housing end terminates at the enclosed space. The housing has a ventilation outlet including an outlet housing end and an outlet evacuation end. The housing end of the ventilation outlet terminates at the enclosed space and the evacuation end of the ventilation outlet terminates external to the toilet. A fan is positioned within the enclosed space, the fan operable to move air from the ventilation inlet through the enclosed space to the ventilation outlet in response to receiving power. A controller is provided for selectively providing power to the fan. An output ventilation hose in direct gaseous communication with the ventilation outlet.

In another embodiment a toilet odor exhaust system is provided. The toilet odor exhaust system has a housing configured to be received in an interior cavity of a toilet. The housing has a top, a bottom, and side walls defining an enclosed space. The housing has a ventilation inlet including a housing end and a toilet end. The toilet end terminates proximate to the toilet and the housing end terminates at the enclosed space. The housing has a ventilation outlet including an outlet housing end and an outlet evacuation end. The housing end of the ventilation outlet terminates at the enclosed space and the evacuation end of the ventilation outlet terminates external to the toilet. A fan is positioned within the enclosed space, the fan operable to move air from the ventilation inlet through the enclosed space to the ventilation outlet in response to receiving power. A controller is provided for selectively providing power to the fan. One or more of the top, the bottom, and the side walls are securely releasable for accessing the enclosed space.

In another embodiment a toilet odor exhaust system is provided. The toilet odor exhaust system has a housing configured to be received in an interior cavity of a toilet. The housing has a top, a bottom, and side walls defining an enclosed space. The housing has a ventilation inlet including a housing end and a toilet end. The toilet end terminates proximate to the toilet and the housing end terminates at the enclosed space. The housing has a ventilation outlet including an outlet housing end and an outlet evacuation end. The housing end of the ventilation outlet terminates at the enclosed space and the evacuation end of the ventilation outlet terminates external to the toilet. A fan is positioned within the enclosed space, the fan operable to move air from the ventilation inlet through the enclosed space to the ventilation outlet in response to receiving power. A controller is provided for selectively providing power to the fan. The housing is dimensioned to be entirely disposed within the base of the toilet.

In another embodiment a toilet odor exhaust system is provided. The toilet odor exhaust system has a housing configured to be received in an interior cavity of a toilet. The housing has a top, a bottom, and side walls defining an enclosed space. The housing has a ventilation inlet including a housing end and a toilet end. The toilet end terminates proximate to the toilet and the housing end terminates at the enclosed space. The housing has a ventilation outlet including an outlet housing end and an outlet evacuation end. The housing end of the ventilation outlet terminates at the enclosed space and the evacuation end of the ventilation outlet terminates external to the toilet. A fan is positioned within the enclosed space, the fan operable to move air from the ventilation inlet through the enclosed space to the ventilation outlet in response to receiving power. A controller is provided for selectively providing power to the fan. The fan is a squirrel cage fan.

In another embodiment a toilet odor exhaust system is provided. The toilet odor exhaust system has a housing configured to be received in an interior cavity of a toilet. The housing has a top, a bottom, and side walls defining an enclosed space. The housing has a ventilation inlet including a housing end and a toilet end. The toilet end terminates proximate to the toilet and the housing end terminates at the enclosed space. The housing has a ventilation outlet including an outlet housing end and an outlet evacuation end. The housing end of the ventilation outlet terminates at the enclosed space and the evacuation end of the ventilation outlet terminates external to the toilet. A fan is positioned within the enclosed space, the fan operable to move air from the ventilation inlet through the enclosed space to the ventilation outlet in response to receiving power. A controller is provided for selectively providing power to the fan. The housing is releasably secured in the interior cavity.

In another embodiment a toilet odor exhaust system is provided. The toilet odor exhaust system has a housing configured to be received in an interior cavity of a toilet. The housing has a top, a bottom, and side walls defining an enclosed space. The housing has a ventilation inlet including a housing end and a toilet end. The toilet end terminates proximate to the toilet and the housing end terminates at the enclosed space. The housing has a ventilation outlet including an outlet housing end and an outlet evacuation end. The housing end of the ventilation outlet terminates at the enclosed space and the evacuation end of the ventilation outlet terminates external to the toilet. A fan is positioned within the enclosed space, the fan operable to move air from the ventilation inlet through the enclosed space to the ventilation outlet in response to receiving power. A controller is provided for selectively providing power to the fan. The fan is in direct gaseous communication with the ventilation outlet.

In another embodiment a toilet odor exhaust system is provided. The toilet odor exhaust system has a housing configured to be received in an interior cavity of a toilet. The housing has a top, a bottom, and side walls defining an enclosed space. The housing has a ventilation inlet including a housing end and a toilet end. The toilet end terminates proximate to the toilet and the housing end terminates at the enclosed space. The housing has a ventilation outlet including an outlet housing end and an outlet evacuation end. The housing end of the ventilation outlet terminates at the enclosed space and the evacuation end of the ventilation outlet terminates at a sewage pipe. A check valve is provided in gaseous communication with the ventilation outlet to permit air to flow unidirectionally from the housing to the sewage pipe. A fan is positioned within the enclosed space, the fan operable to move air from the ventilation inlet through the enclosed space to the ventilation outlet in response to receiving power. A controller is provided for selectively providing power to the fan.

What is claimed is:

1. A toilet bowl ventilation system, comprising:

a toilet including a base and a bowl, the base including an interior cavity;

a seat assembly disposed over the bowl and connected with the toilet, the seat assembly including a toilet seat including an attachment end and a lower surface configured to face the toilet bowl and a body hingedly connected to the attachment end of the toilet seat, the body including an upper surface shaped complementary to the lower surface of the toilet seat proximate to the attachment end, a bottom surface having one or more intake inlets and a seat ventilation outlet in gaseous communication with the one or more intake inlets, and side body walls defining an enclosure, wherein the upper surface of the body extends under the lower surface of the toilet seat proximate to the attachment end to define a channel in gaseous communication with the one or more intake inlets;

a housing disposed within the interior cavity of the base of the toilet, the housing having a top, a bottom, and side walls defining an enclosed space;

a ventilation inlet in gaseous communication with the one or more intake inlets of the seat assembly and the enclosed space of the housing;

a seat ventilation hose attached to the seat ventilation outlet and configured to establish gaseous communication between the one or more intake inlets and the ventilation inlet, wherein the seat ventilation hose extends into the base of the toilet;

a ventilation outlet in gaseous communication with the enclosed space of the housing;

a fan positioned within the enclosed space of the housing, the fan operable to move air from the one or more intake inlets of the seat assembly to the ventilation inlet through the enclosed space of the housing to the ventilation outlet in response to receiving power; and a controller for selectively providing power to the fan.

2. The toilet bowl ventilation system of claim 1, further comprising:

a first ventilation hose in gaseous communication with the one or more intake inlets and the ventilation inlet.

3. The toilet bowl ventilation system of claim 1, wherein the seat assembly comprises one or more buttons to selectively control power to the fan.

4. The toilet bowl ventilation system of claim 1, further comprising:

an output ventilation hose in gaseous communication with the ventilation outlet.

5. The toilet bowl ventilation system of claim 1, further comprising:

a sensor positioned on the seat assembly, the sensor operable to provide an activation signal to the controller indicative of a presence of a body on the toilet seat, wherein the controller is operable to provide power to the fan when the activation signal indicates that the body is present on the toilet seat.

6. The toilet bowl ventilation system of claim 1, wherein one or more of the top, the bottom, and the side walls are selectively removable for accessing the enclosed space.

7. The toilet bowl ventilation system of claim 1, wherein the housing is entirely disposed within the base.

8. The toilet bowl ventilation system of claim 1, wherein the toilet includes a water tank, and wherein the water tank is configured to be disposed against a wall when the toilet is installed.

9. The toilet bowl ventilation system of claim 1, wherein the fan is a squirrel cage fan.

10. The toilet bowl ventilation system of claim 1, wherein the housing is releasably secured in the interior cavity.

11. The toilet bowl ventilation system of claim 1, wherein the fan is in direct gaseous communication with the ventilation outlet.

12. A toilet odor exhaust system, comprising:

a housing configured to be received in a toilet having a base, the housing having a top, a bottom, and side walls defining an enclosed space;

a seat assembly configured to be connected with a toilet, the seat assembly including a toilet seat including an attachment end and a lower surface configured to face the toilet and a body hingedly connected to the attachment end of the toilet seat, the body including an upper surface shaped complementary to the lower surface of the toilet seat proximate to the attachment end, a bottom surface having one or more intake inlets and a seat ventilation outlet in gaseous communication with the one or more intake inlets, and side body walls defining an enclosure, wherein the upper surface of the body extends under the lower surface of the toilet seat proximate to the attachment end to define a channel in gaseous communication with the one or more intake inlets;

a ventilation inlet including a housing end and a toilet end, the toilet end terminating proximate to the toilet and the housing end terminating at the enclosed space of the housing, wherein the toilet end is in gaseous communication with the one or more intake inlets of the seat assembly;

a seat ventilation hose attached to the seat ventilation outlet and configured to establish gaseous communication between the one or more intake inlets and the ventilation inlet, wherein the seat ventilation hose extends into the base of the toilet;

a ventilation outlet including an outlet housing end and an outlet evacuation end, the housing end terminating at the enclosed space of the housing and the evacuation end terminating a distance away from the housing end;

a fan positioned within the enclosed space, the fan operable to move air from the one or more intake inlets of the seat assembly to the ventilation inlet through the enclosed space of the housing to the ventilation outlet in response to receiving power; and a controller for selectively providing power to the fan.

13. The toilet odor exhaust system of claim 12, further comprising an inlet hose in direct gaseous communication with the ventilation inlet and an output ventilation hose in direct gaseous communication with the ventilation outlet.

14. The toilet odor exhaust system of claim 12, wherein one or more of the top, the bottom, and the side walls are securely releasable for accessing the enclosed space.

15. The toilet odor exhaust system of claim 12, wherein the housing is dimensioned to be entirely disposed within a base of a toilet.

16. The toilet odor exhaust system of claim 12, wherein the fan is a squirrel cage fan.

17. The toilet odor exhaust system of claim 12, wherein the housing is configured to be releasably secured in a toilet.

18. The toilet odor exhaust system of claim 12, wherein the fan is in direct gaseous communication with the ventilation outlet.

19. The toilet bowl ventilation system of claim 4, wherein the toilet includes outflow plumbing, and wherein the output ventilation hose is in gaseous communication with the outflow plumbing.

20. The toilet odor exhaust system of claim 12, wherein the ventilation outlet is configured to be in direct gaseous communication with an outflow plumbing of a toilet.

* * * * *